US005360374A

United States Patent [19]

Wyon et al.

[11] Patent Number: 5,360,374

[45] Date of Patent: Nov. 1, 1994

[54] APPARATUS FOR DESKS

[76] Inventors: David Wyon, Westmansgatan 68, S-582 46 Linköping; Stefan Larsson, Sjömansgatan 17 D, S-413 15 Göteborg, both of Sweden

[21] Appl. No.: 30,229

[22] PCT Filed: Jul. 8, 1991

[86] PCT No.: PCT/SE91/00481

§ 371 Date: Mar. 23, 1993

§ 102(e) Date: Mar. 23, 1993

[87] PCT Pub. No.: WO92/01893

PCT Pub. Date: Feb. 6, 1992

[30] Foreign Application Priority Data

Jul. 23, 1990 [SE] Sweden ..... 9002495

[51] Int. Cl.[5] ..... F24F 3/00; F24F 7/06

[52] U.S. Cl. ..... 454/306; 454/256

[58] Field of Search ..... 454/256, 306, 329, 903

[56] References Cited

U.S. PATENT DOCUMENTS

| | | | |
|---|---|---|---|
| 1,194,527 | 8/1916 | McNamara | 454/306 X |
| 2,572,120 | 10/1951 | Dixon | 454/230 |
| 2,734,990 | 2/1956 | Leuschner . | |
| 3,309,500 | 3/1967 | Reynolds . | |
| 4,135,440 | 1/1979 | Schmidt et al. . | |
| 4,545,379 | 10/1985 | Jenkins | 454/306 X |
| 4,784,445 | 11/1988 | Ott | 312/236 |
| 4,987,896 | 1/1991 | Nakamatsu . | |

FOREIGN PATENT DOCUMENTS

| | | | |
|---|---|---|---|
| 0207718 | 6/1989 | European Pat. Off. . | |
| 2033466 | 2/1972 | Germany . | |
| 2407448 | 8/1975 | Germany . | |
| 59-23336 | 2/1984 | Japan . | |
| 61-11535 | 1/1986 | Japan | 454/306 |
| 62-14161 | 1/1987 | Japan . | |
| 63-204050 | 8/1988 | Japan | 454/230 |
| 90/06476 | 6/1990 | WIPO . | |

OTHER PUBLICATIONS

"Personal Environments", Publication No. 2423, Johnson Controls, Inc., 1989.

"Climadesk", Mikroklimat Sweden AB, Bromma, Sweden, Date unknown.

English translated Abstract, 457,409 Sweden.

*Primary Examiner*—Harold Joyce

*Attorney, Agent, or Firm*—Browdy and Neimark

[57] ABSTRACT

An apparatus for desks for influencing the exchange of heat between a person sitting at the desk (4) and the ambient air comprises an air stream generating member (8–10, 12, 13) and a heater device (2) arranged to cause air with a temperature differing from the main room air to enter into contact with substantial surface portions of the person's body.

20 Claims, 5 Drawing Sheets

APPARATUS FOR DESKS

FIELD OF THE INVENTION AND PRIOR ART

The present invention relates to an apparatus for desks for influencing the exchange of heat between a person sitting at the desk and the ambient air.

It is well known that there may be very great differences between different persons concerning how they experience one and the same climate condition, for instance in a room with approximately normal room temperature, in particular when the persons are seated. This may depend on differences in clothing, activity level, tiredness and the individual basic heat generating and emission level of the body of a person inter alia depending on the clothes habits established. Furthermore, personal feelings also matter—e.g. some persons like to "be cold" while others hate it.

These differences in experiences of one and the same climate of course give rise to problems, when a great number of persons have to stay in one and the same room for a longer period of time, such as for instance in an office with several desks placed in one and the same room, which is built up as an office landscape. However, hitherto existing climate plants for such rooms have not taken said differences into consideration, but tried to establish the same thermal conditions in the whole room, which logically always leads to that some of the persons being in the room will not be satisfied with the conditions prevailing. Should any person say that he is cold and wish a temperature rise, it will often take a comparatively long time before this could be realized and the power consumption will thus be considerable, and at the same time any other person may get angry because it gets too hot for him.

It would therefor be desirable to provide an apparatus making it possible to influence the so called micro climate at one single desk in such an office landscape, and do this in a remarkable way while almost negligibly influence the micro climate at neighbouring desks. It would then also be desired that such an apparatus enables very rapid changes of the climate conditions for the person sitting at the desk in question as well as that the air quality (the degree of freshness, percentage of outdoor air) in the inhalation organs is under the control of the individual.

BRIEF DESCRIPTION OF THE INVENTION

The object of the present invention is to provide an apparatus with the desired features mentioned above for influencing the climate conditions in the immediate vicinity of a desk.

This object is obtained by providing an apparatus of the kind mentioned in the introduction with means arranged to cause air with a temperature differing from the main room air to enter into contact with substantial surface portions of the body of a person sitting at the desk.

The heat exchange between the body of the person sitting at the desk and the ambient room air may by an apparatus of that kind be considerably influenced, without persons sitting at a very short distance, down to about 1 meter, from the desk feeling any change in climate. This means that, starting from a basic room climate adapted to the needs of the majority, a person having quite different needs than the average will be satisfied without any disadvantage of the other people working.

An apparatus of the type according to the invention enables also a very rapid and accordingly a proper influence of the micro climate at a desk demanding low costs.

The definition desk does not exclusively comprise conventional desks, but also other types of tables which like desks function as a working place for a seated person.

According to a preferred embodiment of the invention said means comprise air stream generating members arranged to generate streams of air having a temperature differing from the main room air from a region located under the desk top in front of and at least at the height that the knees of a person sitting at the desk would have and towards the trunk of such a person while passing above the thighs of the person. Such an apparatus gives rise to very large surface portions of the body of the person in question being touched by air with a temperature differing from the main room air, so that the heat exchange between the body of the person and the surrounding air is very remarkably changed, but despite this this change will not be noticed at a very short distance from the desk.

According to a very preferred embodiment of the invention said means comprise a device arranged to cause thermal energy to propagate from the region under the desk top and downwardly towards the thighs and calves of a person sitting at the desk. Such a heat supply is very pleasant and influences at the same time considerably the heat exchange of the person with the environment. The thermal energy is transmitted to the body mainly by heat radiation from the device. Although said device will primarily warm up the thighs of the person by heat radiation a certain part of the thermal raise coming from the device will warm up the air under the table top and the definition "means arranged to cause air with a temperature different from the main room temperature to enter into contact with substantial surface portions of the body of a person sitting at the desk" is therefor to be interpreted as also comprising the case in which only said device constitutes these means.

The fact that warm air rises results in already known desks in that the region around the feet of a person gets cold and the head region warm, so that the person sitting at the desk gets trouble with cold feet and warm inhalation air. The present invention finds a remedy for this in a preferred embodiment by connecting the air stream generating member to a source of air with a lower temperature than that of the main room air. This in combination with the possibility to when necessary switch on the device mentioned above for heat radiation from the region under the desk top and downwardly towards the thighs and calves of the person sitting at the desk, make it possible to change the "slope of the thermal profile", so that the person in question can get warm feet and simultaneously cool air to breathe. Thus, this embodiment of the invention counteracts the temperature gradient normally arising by the rising of warm air, and owing to the fact that said device influences the thighs of the person and the air stream generating members cause air with a lower temperature than the ambient room air to flow to the trunk of a person, such large surface portions of the person's body may be influenced by the apparatus, that the apparatus very efficiently can cause big changes of the micro climate of the person according to the desires of the latter.

According to a further preferred embodiment of the invention the air stream generating members are arranged to generate streams of air from the front edge of the desk facing a person sitting there and upwardly towards the region of the head of the person without striking the trunk thereof, so that it will be possible to supply cool fresh air to the region of the head of the person also when cooling influence of the person is not aimed at. Thus, a person sitting at the desk can always be provided with cool fresh air, even should he be a little bit cold, since in the last mentioned embodiment this air does not to a substantial extent influence the heat exchange between the body of the person and the environment. The apparatus is preferably provided with means for regulating the air streams coming from the air stream generating member for varying the proportion of them striking against the trunk of the person and leaving the person substantially uninfluenced.

Further advantages and preferred characteristics of the invention will appear more clearly from the following description and the other dependent claims.

BRIEF DESCRIPTION OF THE DRAWINGS

With reference to the appended drawings, below follows a specific description of a preferred embodiment of the apparatus according to the invention cited as an example.

In the drawings.

DETAILED DESCRIPTION OF PREFERRED EMBODIMENTS OF THE INVENTION

Figure 1:
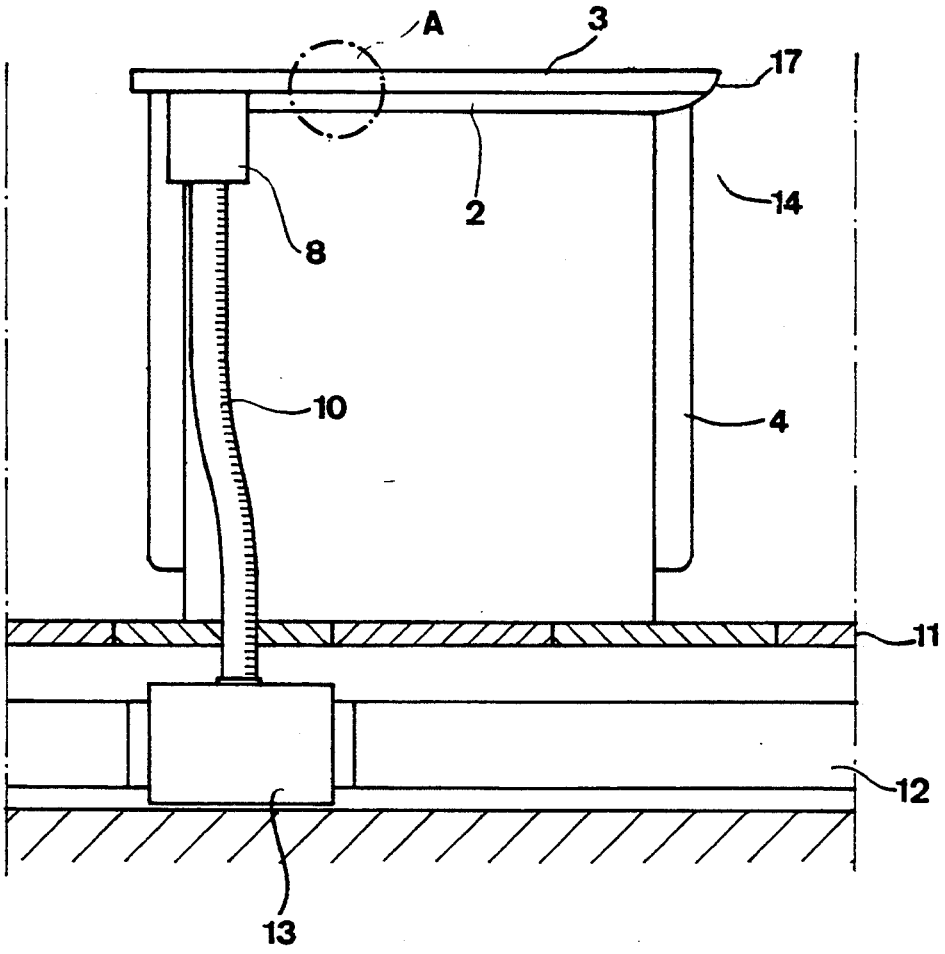
FIG. 1 is a very schematic side view of an apparatus according to the invention applied to a desk, one lateral side of the desk being removed and a section being taken through the floor located under the desk.
Figure 2:
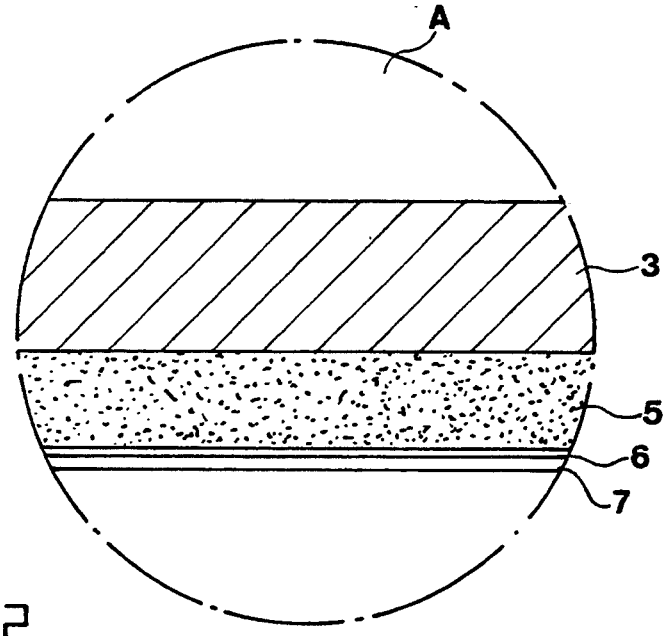
FIG. 2 is an enlarged section view of a detail of the apparatus according to FIG. 1.
Figure 3:
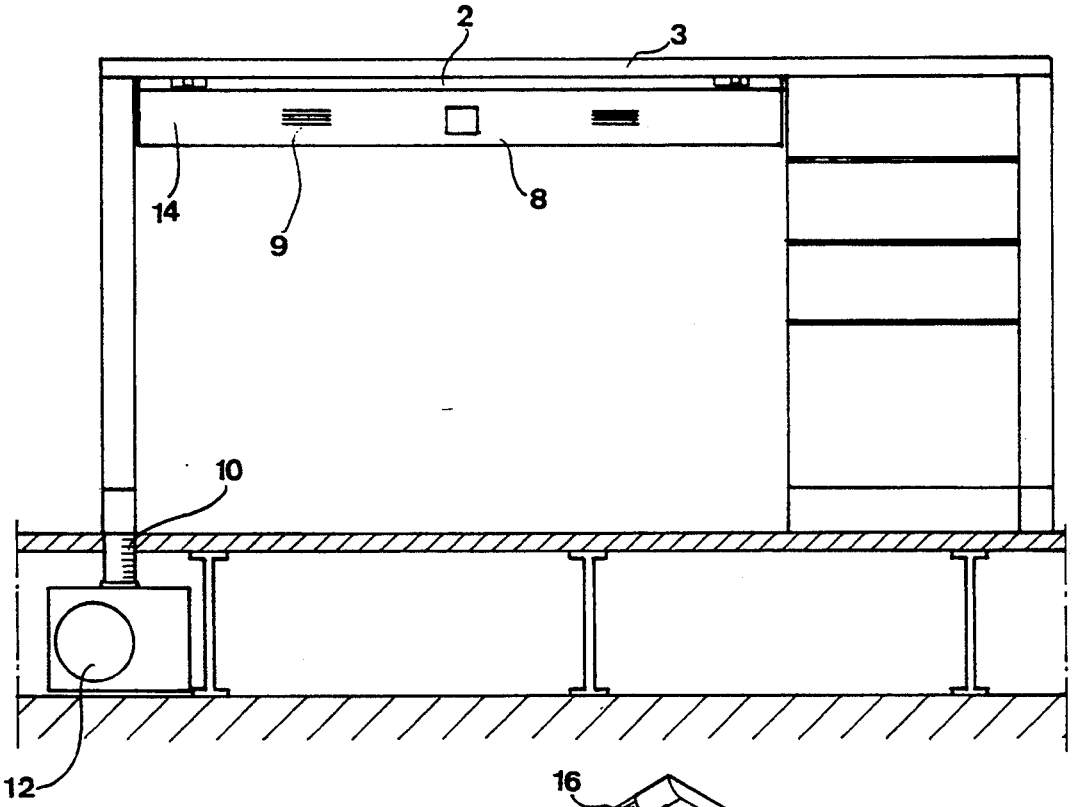
FIG. 3 is a front view of the desk according to FIG. 1 with the floor located thereunder in a sectioned view.
Figure 4:
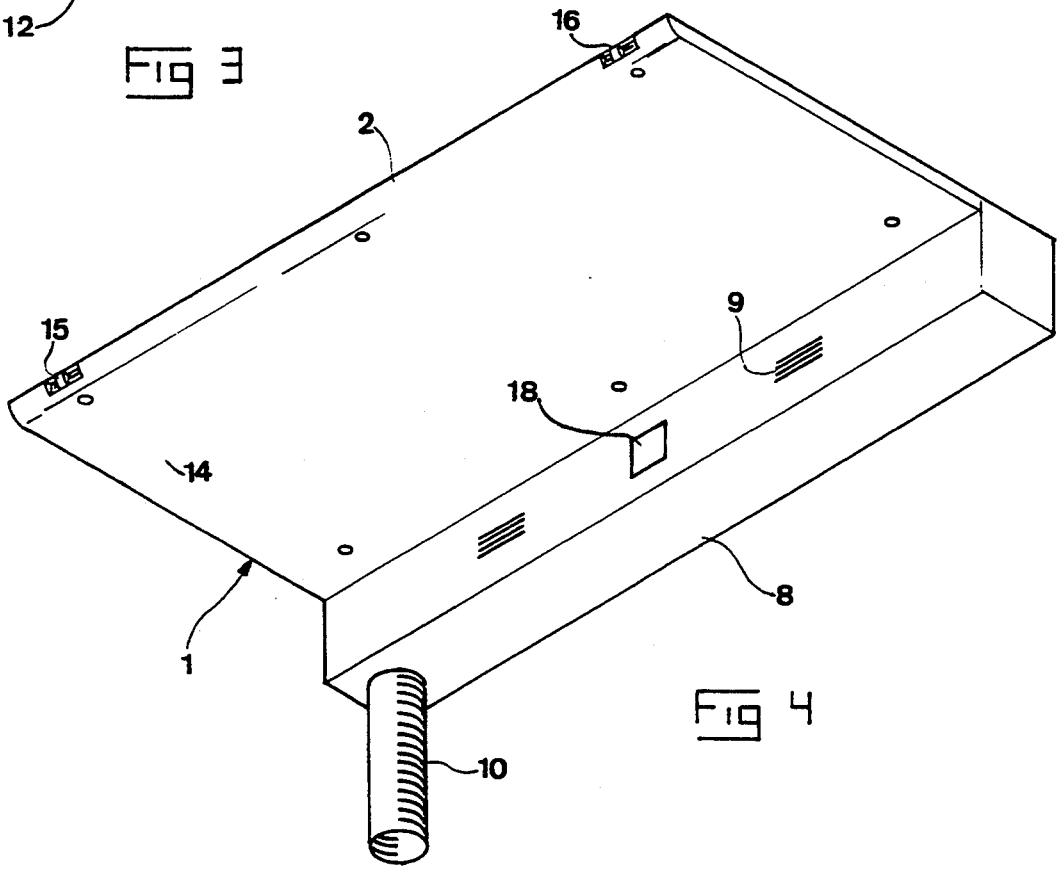
FIG. 4 is a perspective view of the apparatus according to the invention.

The construction of a preferred embodiment of the apparatus according to the invention will now be explained with reference simultaneously made to FIGS. 1–4. The apparatus according to the invention may either be incorporated in a desk in the manufacturing thereof or be produced as a separate unit, which afterwards may be applied to different types of desks already existing. A device according to the last mentioned case is shown in the drawings, but this is accordingly not to be considered as limitative.

The apparatus 1 according to the invention (see FIG. 4) presents a sheet 2, which is arranged to be secured on the underside of a top 3 of a conventional desk 4. The sheet 2 is intended to cover substantially the entire thighs of a person sitting in a normal position close to the desk as seen directly from above in a state applied to the desk, wherein said sheet may have an area of for instance 80×80 cm. The configuration of the sheet is closer represented in FIG. 2. It is a multi-layer one, and the upper layer 5 in the state applied to the desk top 3 consists of heat insulating material, such as polystyrene or neoprene, a heater element layer 6 located thereunder, which may consist of conducting rubber with a high thermal coefficient making overheating at any point impossible, and a lower protection foil 7. The heater element layer 6 is connected to a source of electric energy not shown. The heating of the heater element layer 6 will thanks to the arrangement of the upper insulating layer 5 lead to that heat will propagate downwardly under the desk top so as to strike against the thighs and calves of a person sitting at the desk (see the small arrows in FIG. 5 ).

The apparatus according to the invention also comprises an air stream generating member, which comprises a fan device arranged to blow out air with a lower temperature, for instance 16°–19° C., than the rest of the room air through two openings 9 arranged in an elongated box 8. The box 8 is through a conduit 10, connectable to a ventilating system 12 arranged under the floor 11 in the room in which the desk is intended to be placed. The ventilating system 12 has a distribution unit 13 for the connection of the conduit 10 to the ventilating system. When such a ventilating system exists it will be advantageous to mount a filter, a fan device for generating air streams coming out of the opening 9 and a throttle to shut them off in a box in the distribution unit under the floor 11. However, it would also be conceivable to arrange this box on the outer wall (the inner side of the face), and this would probably be most convenient in this case, since the room in question is not provided with any under-floor-ventilation. In such a case it may be suitable to place the desk close to an outer wall and in that way lead colder air to a device mixing this with tempered air, so that the air blown out through the openings 9 gets a suitable temperature.

A control unit 14 is arranged at the front edge of the sheet 2. This unit comprises members 15, 16, which here consist of two sliding potentiometers hidden in the front edge of the sheet 2 for regulating the fan device/the throttle of the air stream generating member and the amount thermal energy emitted by the heater element layer 6 of the sheet. To the control unit 14 a member 18 detecting infra-red radiation is also connected, said member being arranged to detect whether a person is sitting at the desk or not. This member is preferably arranged on the front side of the box 8 and to emit signals switching the energy supply to the apparatus according to the invention on and off in dependence on whether a person is at the desk or not. The IR-detector may be arranged to switch the energy supply to the apparatus on as soon as a person sits down at the desk, but switch the energy supply off for instance 5 minutes after the person has left the desk. No electrical wires to the apparatus has been shown in the Figures, but they are preferably hidden inside the sheet 2, the box 8 and the conduit 10, or on the outside of the latter. It is also conceivable that such electrical wires lead to electrical sockets or terminals arranged on the rear side of the desk, which may be separated from electrical voltage by the IR-detector, for instance so as to switch off a table-lamp.

The openings 9, out of which air having a lower temperature than the rest of the room air may be brought to flow, is of a honeycomb configuration and arranged to direct air streams emanating therefrom under the desk top substantially parallel thereto, so that they are substantially a tangent to the upper side of the thighs of the person sitting in a normal position at the desk and after that are a tangent to the trunk of the person. The trunk of the person has the large body surfaces for heat exchange with the surrounding air, and the striking thereagainst of colder air may considerably increase the ability of the person to emit heat to the environment. The greatest part of undesired sweating also takes place here at too high an ambient temperature, for instance in the arm pits. Such heat emission is also facilitated by the air streams passing above the thighs of the person, which assists the convection from the thighs of the person. The front edge 17 of the desk directed towards the person is chamfered or rounded in the direction upwardly and forwardly for deflecting the air streams coming from the openings 9 upwardly along the trunk of the person. The front edge of the sheet 2 is also chamfered, so that it after mounting under the desk top forms a continuation of the arc form of the front edge thereof. Additionally, the openings 9 are preferably directed at an angle away from each other and to form a V-shape as seen from above by the two main air streams emanating therefrom, said angle being chosen so that the air streams passing upwardly along the trunk of the person reach an arm pit region thereof each without creating any draught upwardly into the face.

The openings may in another version be laterally displaceable, so that an adjustability to thin and broad people is provided, so that it then may be blown on both sides of the trunk of which without blowing directly upwardly into the face (which would be experienced as unpleasant).

Figure 5:
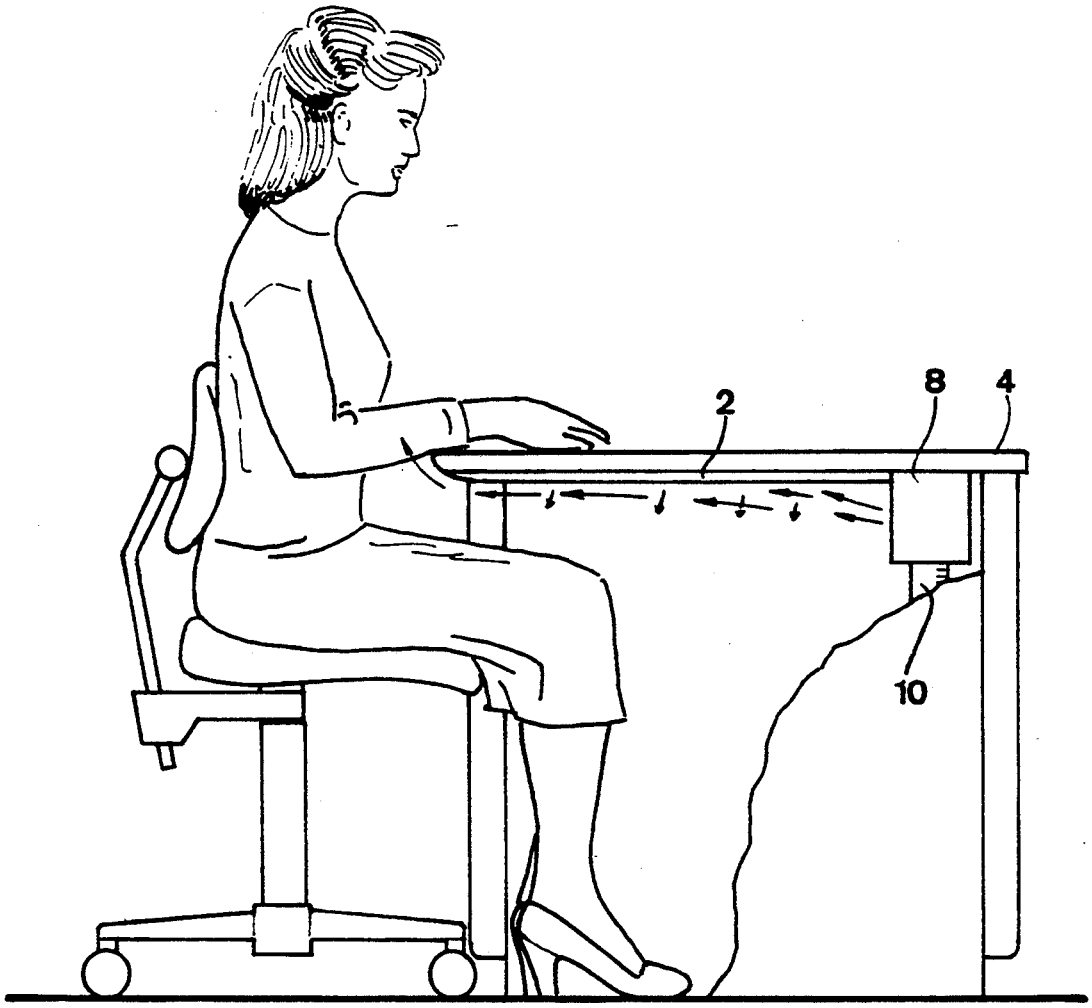
FIG. 5 is a side view illustrating the function of the apparatus according to the invention, a part of the lateral wall of the desk in question being broken away.

The propagated directions for heat radiation generated by the heater element layer 6 and air streams coming from the openings 9 are indicated in FIG. 5 by short and long arrows, respectively. Although these arrows are present in the same figure, probably only one of these two types will be present on one and the same occasion. The air streams indicated by long arrows when the person finds the overall room climate too warm, and the shorter arrows in the opposite case. But it would also be conceivable when the person feels very cold but wants to breathe more fresh air, to have the heater element layer switched on and at the same time blow air of room temperature out through the openings 9, which accordingly is heated on passing under the sheet 2 and then strikes against and warms up the trunk of the person. It is shown how the air from the openings 9 is drawn upwardly towards the sheet 2 by the so called "Bernoulli-effect" and therefrom may pass the thighs without any discomfort, when desired, at low rates.

Figure 6:
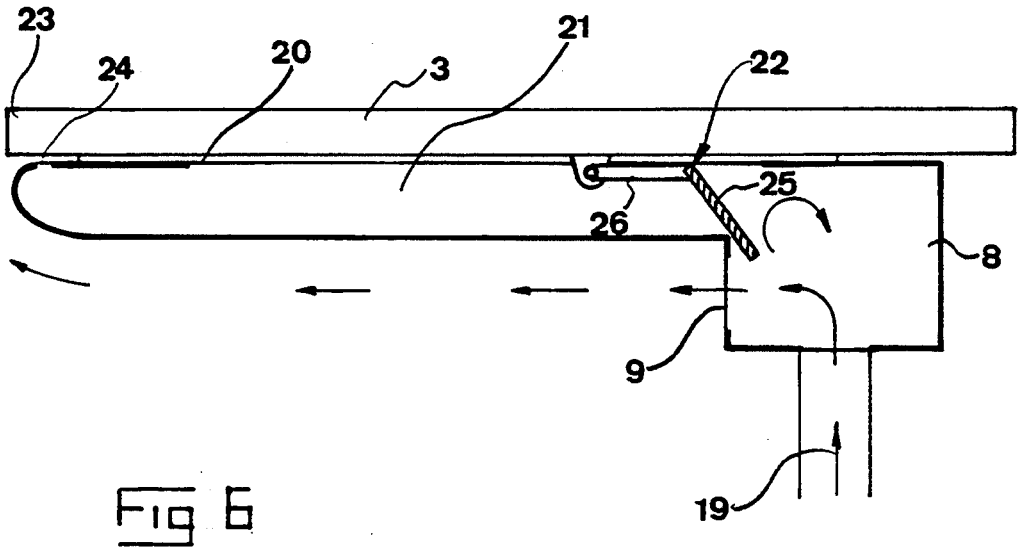
FIGS. 6 and 7 illustrate schematically how the air stream generating member may be regulated according to a second embodiment of the invention.
Figure 7:
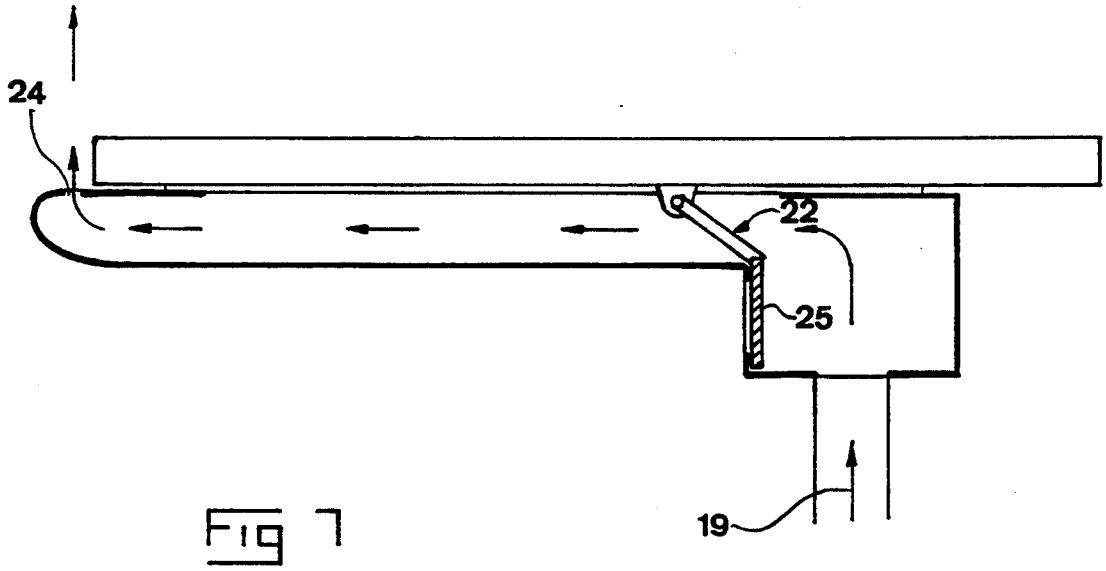

It is schematically illustrated in FIGS. 6 and 7 how the air streams 19 coming from the air stream generating member according to a second embodiment of the invention may be regulated to take different courses in dependence on whether a cooling need exists or one only wishes to have a supply of fresh air. The box 8 and a cavity 21 emerging therein and provided by an elongated hollow element 20 are in this embodiment displaceably arranged under the desk top 3. A throttle 22 is arranged at the connection between the interior of the box 8 and the cavity 21. The element 20 has at its end close to the front edge 23 of the desk an opening 24 directed substantially upwardly.

The throttle 22 has a tight part 25 and a part 26 pervious to air connected to each other at an angle, the throttle being pivotably connected to the underside of the desk top 3 through the latter. The air streams 19 arriving to the interior of the box will in the position according to FIG. 6 by the tight part 25 of the throttle be prevented from entering into the cavity 21 and instead flow outwardly through the opening 9 of the box so as to pass over the thighs of the person sitting at the desk and on deflection upwardly strike against the trunk thereof. This is the appropriate position in cases where the person feels that it is too warm where he or she sits and wishes to be "cooled down".

Should it however be so that the person in question thinks that it is cold enough and only wishes to breathe fresh air, the box 8 is displaced with the element 20 in the direction towards the front edge 23, i.e. to the left in FIG. 6, whereby the throttle bearing with its tight part 25 upon the edge between the box 8 and the cavity 21 is allowed to under the influence of the gravitation pivot downwardly to the position according to FIG. 7, in which the throttle shuts the opening 9 off, so that the air streams 19 are led through the cavity 21 and out of the opening 24 and upwardly towards the regions of the head of a person sitting at the desk without striking against the trunk thereof.

Different intermediate positions between the two extreme positions shown in FIG. 6 and 7 are of course possible, in which one part of the air flows through the opening 24 and one part through the opening 9.

The element 20 may of course be displaceably arranged with respect to the sheet 2 or emitting heat radiation downwardly towards the thighs of the person instead of the underside 3 of the desk top, or the whole assembly of sheet 2 and element 20 with box 8 could be displaceable with respect to the desk top.

The intention is that the cavity 21 is branched into two elongated channels extending in the direction towards the front edge of the desk and forming substantially a V as seen from above, which in the region of the opening 24 are interconnected, so that this opening consists of a slit directed upwardly and extending substantially parallel to the front edge 23. Other structures of this opening 24 are also possible, and it would be conceivable to have a series of small openings instead of a slit.

Figure 8:
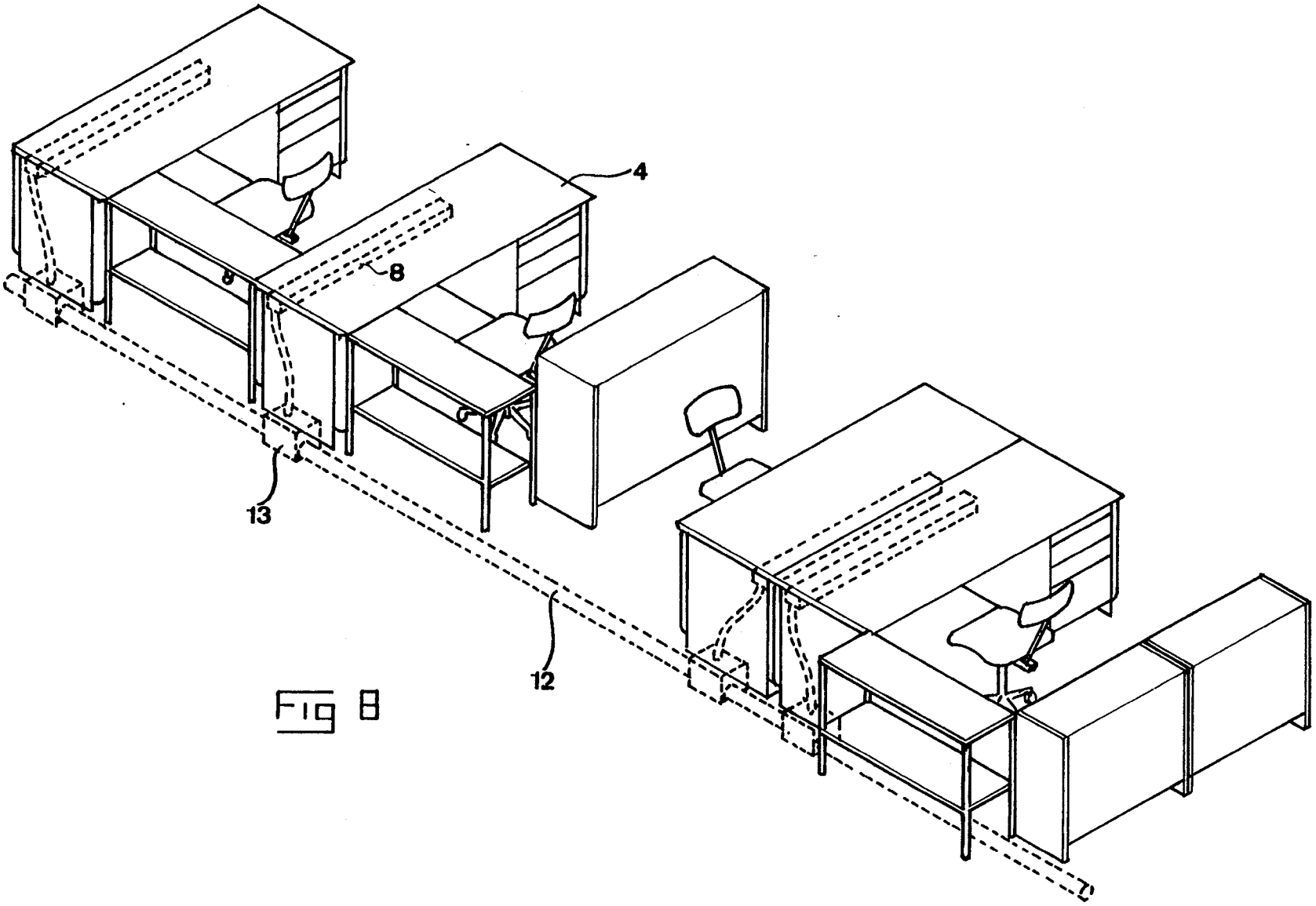
FIG. 8 is a part of an office landscape built up with desks provided with the apparatus according to the invention.

It is shown in FIG. 8 how several desks in an office landscape may have one apparatus of the type according to the invention each and be connected to a common ventilating system 12, located under the floor surface and indicated by dashed lines, which is with or without air conduits. However, the most common type of floor ventilation has no channels, but the air circulates freely under the floor, and the boxes 13 may then be freely located under the floor without any connection. They simply take the air present where they are.

Thanks to the provision of the apparatus according to the invention each of the persons sitting at the desks can to a considerable extent influence their own micro climate without influencing the climate conditions at adjacent desks. This is accomplished in a very easy way by actuating any of the two regulating members 15, 16. Air of +16°–+19° C. is thereby preferably supplied through the openings 9 or the air being closest under the top is heated to from +25° to +50° C.

The apparatus according to the invention is advantageously connected to a climate plant for the whole room in which the desk provided with the apparatus is located and arranged to give this plant impulses to influence the room climate in the same way, cooling and heating, respectively, as the apparatus influences the micro climate at the desk. Owing to this characteristic it is possible to ensure through the apparatus according to the invention that the main climate plant works in the way with which most of the persons present in the room are satisfied. Thus, should most of the persons find the room too cold and as a consequence thereof switch a heater element 6 on, impulses bearing evidence of their complaints are sent to the main climate plant, which as a response thereto over a longer time causes a temperature rise in the room.

Experiments carried out with a thermal doll has shown that the apparatus according to the invention has a capability to influence the total heat loss of a human being by 25 $W/m^2$ around the level 60 $W/m^2$ which is the level for the total heat loss in office work. This corresponds to a change of the room temperature with 4° C., which should be sufficient so that each person present in an office space starting from the overall climate prevailing in the room will be able to establish a climate in his particular working zone coinciding with his desires.

The apparatus according to the invention may as already mentioned occur as a single unit applicable to desks already existing (FIG. 4) or in the manufacturing of desks be completely integrated therewith. Thus, the apparatus may be marked through sale channels for furniture as well as such for heating and ventilating systems.

The invention is of course not in any way restricted to the preferred embodiment described above, but several possibilities to modify it would be apparent to a man skilled in the art without departing from the basic idea of the invention. For example, the dimensions and the forms of the sheet including the heater element layer may be other than as illustrated. The openings for air streams from the region in front of the knees of a person sitting at the desk could be more than two to the number or only one, and they could have another shape than the one shown in the figures.

Furthermore, the control unit could be arranged on another suitable place and the box out of which the air streams emerge may be replaced by an arbitrary member with a similar function.

We claim:

1. An apparatus for desks for influencing the exchange of heat between a person sitting at a desk and the ambient air, said apparatus comprising means (2, 8–10, 12, 13) for causing air with a temperature differing from the main room air to enter into contact with a body of the person, wherein said means comprise air stream generating members (8–10, 12, 13) connected to a source of air with a lower temperature than that of the main room air and arranged to generated air streams having a lower temperature than the main room air from a region located under a top of the desk in front of and at least at a height that knees of the person sitting at the desk would have and towards a trunk of the person while passing above thighs of the person, said means further comprising a heater device (2) arranged to generate heat radiation to propagate from the region directly under the top of the desk and downwardly towards the thighs and calves of the person sitting at the desk.

2. An apparatus according to claim 1, wherein said members comprise two openings (9) arranged in said region and connected to a supply air conduit (10), the two openings being arranged to direct each of the air streams emerging therefrom so that they are substantially tangent to an upper side of the thighs of the person sitting at the desk in a normal position and thereafter each respectively strike against substantially one half of a trunk of one person with respect to the medial plane of the body.

3. An apparatus according to claim 2, wherein the openings (9) are arranged to direct the air streams under top (3) of the desk substantially parallel thereto, and that a front edge (17) of the top of the desk directed towards the person is chamfered in the direction upwardly and forwardly for deflecting said air streams upwardly along the trunk of the person.

4. An apparatus according to claim 3, wherein the openings (9) are directed at an angle to each other and to create a V-shape as seen from above by the two air streams coming therefrom, and that said angle is chosen to make the air streams pass upwardly along the trunk of the person to reach an arm pit region thereof.

5. An apparatus according to claim 1, wherein the air stream generating members are connected to a ventilating system (12) located under the floor of the room in which the desk is arranged and which is common to several desks (4) in an office landscape.

6. An apparatus according to claim 1, wherein the heater device comprises a multi-layer sheet (2) arranged to be attached to the underside of a desk top (3) and that the sheet comprises a layer (5) of heat insulating material being the upper one in a state in which said sheet being applied to the desk top and a heater element layer (6) arranged thereunder connected to a power source in order to be heated and emit heat radiation in the direction downwardly under the sheet.

7. An apparatus according to claim 6, wherein the sheet (2) is arranged to substantially cover the thighs of the person sitting in normal position close to the desk as seen straightly from above in said state.

8. An apparatus according to claim 1, further comprising a detecting member detecting infra-red radiation arranged to detect whether the person is sitting at the desk or not, the detecting member arranged to send signals switching the power supply to said means on and off when a person sits down at the desk or leaves the desk, respectively.

9. An apparatus according to claim 8, wherein said detecting member has a time delay.

10. An apparatus according to claim 1, wherein the apparatus is connected to an air-conditioning plant for a whole room in which the desk is located and arranged to give the plant impulses to influence the room climate in the same way as the apparatus influences the microclimate at the desk.

11. An apparatus according to claim 1, wherein the air stream generating members (8–10, 12, 13) are arranged to generate air streams with a temperature differing from the main room air from the front edge (23) of the desk facing the person sitting thereat and upwardly towards the region of a head of the person without striking a trunk thereof.

12. An apparatus for desks for influencing the exchange of heat between a person sitting at a desk and the ambient air, said apparatus comprising means (2, 8–10, 12, 13) for causing air with a temperature differing from the main room air to enter into contact with a body of the person, wherein said means comprise air stream generating members (8, 10, 12, 13) arranged to generate air streams having a temperature differing from the main room air from a region located under a top of the desk in front of and at least at a height that knees of the person sitting at the desk would have and towards a trunk of the person while passing above thighs of the person, said members (8, 10, 12, 13) comprising two openings arranged in said region and connected to a supply air conduit, the two openings being arranged to direct the air streams emerging therefrom so that each of the air streams are substantially tangent to an upper side of the thighs of the person sitting at the desk in a normal position and thereafter each respectively strike against substantially one half of the trunk of the person with respect to the medial plane of the body, said means further comprising a heater device arranged to cause heat energy to propagate from the region under the top of the desk and downwardly towards the thighs and calves of the person sitting at the desk.

13. An apparatus according to claim 12, wherein the openings (9) are arranged to direct the air streams under top (3) of the desk substantially parallel thereto, and that a front edge (17) of the top of the desk directed towards the person is chamfered in the direction upwardly and forwardly for deflecting said air streams upwardly along the trunk of the person.

14. An apparatus according to claim 13, wherein the openings (9) are directed at an angle to each other and to create a V-shape as seen from above by the two air streams coming therefrom, and that said angle is chosen to make the air streams pass upwardly along the trunk of the person to reach an arm pit region thereof.

15. An apparatus according to claim 12, wherein the air stream generating members are to be connected to a ventilating system (12) located under the floor of the room in which the desk is intended to be arranged and which is common to several desks (4) in an office landscape.

16. An apparatus according to claim 12, wherein the heater device comprises a multi-layer sheet (2) arranged to be attached to the underside of a desk top (3) and that the sheet comprises a layer (5) of heat insulating material being the upper one in a state in which said sheet being applied to the desk top and a heater element layer (6) arranged thereunder and to be connected to a power source in order to be heated and emit heat radiation in the direction downwardly under the sheet.

17. An apparatus according to claim 16, wherein the sheet (2) is arranged to substantially cover the thighs of the person sitting in normal position close to the desk as seen straightly from above in said state.

18. An apparatus according to claim 12, further comprising a detecting member detecting infra-red radiation arranged to detect whether the person is sitting at the desk or not, the detecting member arranged to send signals switching the power supply to said means on and off when a person sits down at the desk or leaves the desk respectively.

19. An apparatus according to claim 18 wherein said detecting member has a time delay.

20. An apparatus according to claim 12, wherein the apparatus is connected to an air-conditioning plant for a whole room in which the desk is located and arranged to give the plant impulses to influence the room climate in the same way as the apparatus influences the microclimate at the desk.

* * * * *